US006450658B1

(12) United States Patent
Tsuji et al.

(10) Patent No.: US 6,450,658 B1
(45) Date of Patent: Sep. 17, 2002

(54) CEILING FAN WITH LIGHT ASSEMBLY

(75) Inventors: Masao Tsuji, Germantown; Glennbruce S. Campbell, Memphis, both of TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 09/825,777

(22) Filed: Apr. 5, 2001

(51) Int. Cl.[7] ..... F21V 33/00

(52) U.S. Cl. ..... 362/96; 362/147; 362/343; 362/404; 362/294; 416/5

(58) Field of Search ..... 362/147, 404, 362/408, 96, 294, 307, 343; 416/5

(56) References Cited

U.S. PATENT DOCUMENTS 6,019,577 A * 2/2000 Dye ..... 416/5
6,160,956 A * 12/2000 Pelonis ..... 362/361

* cited by examiner

*Primary Examiner*—Stephen Husar
*Assistant Examiner*—Bertrand Zeade
(74) *Attorney, Agent, or Firm*—Baker, Donelson, Bearman & Caldwell

(57) ABSTRACT

A ceiling fan (10) is disclosed having a downrod (11), a motor (12), a radial array of fan blades (13) coupled to blade irons (14) mounted to the motor (12), a bowl shaped lower housing (17) positioned above the blade irons (14), a bowl shaped upper housing (18) positioned concentrically within the lower housing (17), and an upper light assembly (21) positioned within the upper housing (18). The lower housing (17) has a peripheral side wall (23) having a reflective interior surface (24). The upper housing (18) has an annular array of openings (26) in which are mounted translucent windows (27). The opening (26) and corresponding window (27) are mounted generally between the upper light assembly (21) and the peripheral side wall (23) of the lower housing (17), so that light radiating from the upper light assembly passes through the window (27) and is reflected off the interior surface (24) of the lower housing (17) back onto the exterior surface of the upper housing (18).

15 Claims, 1 Drawing Sheet

CEILING FAN WITH LIGHT ASSEMBLY

TECHNICAL FIELD

This invention relates generally to ceiling fans, and more particularly to ceiling fans having light assemblies.

BACKGROUND OF THE INVENTION

Ceiling fans having a number of motorized rotating blades have existed for many years. Many of today's ceiling fans include a light assembly which may be used in the place of a light fixture mounted to the ceiling. These light assemblies typically are mounted to the bottom of the ceiling fan below the plane of rotation of the fan blades.

The positioning of the light assembly below the rotating blades however causes a strobe like effect upon the ceiling. This strobe effect is caused by the light passing from the light assembly and through the rotating blade before it illuminates the ceiling, thereby causing the blade to cast a momentary shadow upon the ceiling.

Light assemblies have also been mounted above the rotating blades of the ceiling fan. Here, however, the downward passage of the light causes a strobe effect throughout the room in which the ceiling fan is mounted, for the light passes through the rotating blades prior to illuminating the room below the ceiling fan.

To reduce the strobe effect problem associated with light assemblies, ceiling fans have also been designed to include both a lower light assembly positioned within a lower housing below the blades and an upper, second light assembly positioned within an upper housing above the blades. The upper light assembly projects light upon the ceiling while the lower light assembly projects light downwardly about the room. However, as these light assemblies are each positioned within housing which prevent the light from passing through the adjacent rotating blades the motor housings of these fans are outside the illumination pattern of either light assembly, and is therefore darkened from view.

To solve this problem a ceiling fan has been designed which includes a third light assembly positioned outside the upper housing and above the lower light assembly, as shown in U.S. Pat. No. 6,019,577. The ceiling fan also includes a shield positioned below the third light assembly which prevents light emanating from the third light assembly from passing through the rotating blades. The costs associated with this type of ceiling fan however increases due to the inclusion of the third lighting assembly and shields. Furthermore, as the third light assembly is positioned closely adjacent the upper housing the light therefrom appears concentrated upon the upper housing directly adjacent the third light source, giving the upper housing an uneven lit appearance.

Accordingly, it is seen that a need remains for a ceiling fan having a lighting assembly which does not create a strobe effect but which also illuminates the exterior of the housing. It is to the provision of such therefore that the present invention is primarily directed.

SUMMARY OF THE INVENTION

In a preferred form of the invention a ceiling fan comprises an electric motor, a plurality of blades coupled to the motor, a lower housing having a light reflective interior surface, an upper housing having an upper portion above the lower housing and at least one opening therethrough, and a light source mounted within the upper housing positioned to radiate light through the upper housing opening and onto the lower housing interior surface. With this construction, a portion of the light passing through the opening and onto the interior surface is reflected onto and thereby illuminates the exterior of the upper housing.

DETAILED DESCRIPTION

Figure 1:
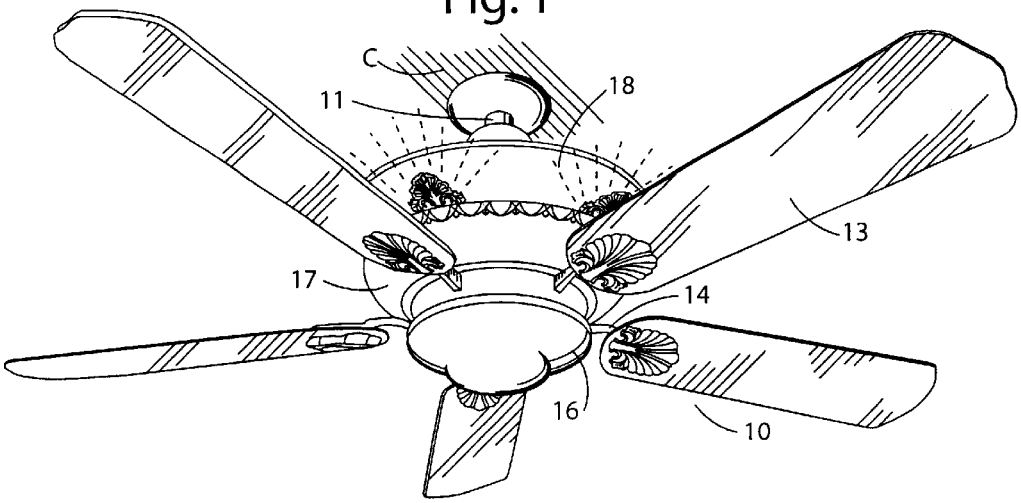
FIG. 1 is a perspective view of a ceiling fan embodying principles of the invention in a preferred form.

With reference next to the drawings, there is shown a ceiling fan 10 suspended from a ceiling c in a preferred form of the invention. The ceiling fan 10 has a downrod 11 coupled to the top of a motor 12 to which is mounted a radial array of fan blades 13 through corresponding blade irons 14. The ceiling fan 10 also has a lower light assembly 16 positioned below the motor 12 and blade irons 14, a bowl shaped lower housing 17 positioned above the blade irons 14, and a bowl shaped upper housing 18 positioned concentrically within the lower housing 17 with at least an upper portion extending above and facing the lower housing 17. Lastly, an upper light assembly 21, shown herein as an annular, tubular light, is positioned concentrically within the upper housing 18.

The motor 12 extends through an opening at the lower end of the lower housing 17. The blade irons 14 are coupled to the motor 12 at predetermined locations depending on the desired number of fan blades 13. Although the fan is shown in the preferred embodiment with five blades, any number of fan blades may be used as dictated by convention. Thus, rotational motion produced by the motor 12 will produce air circulation through rotational movement of the fan blades 13.

The lower housing 17 has a side wall 23 having a generally concave interior surface 24. The interior surface 24 has a light reflective quality, which may be obtained by polishing the interior of a metallic upper housing.

The upper housing 18 has an annular array of openings 26 therethrough. A translucent window 27, in the form of a medallion, is mounted within each opening 26. The openings 26 and corresponding windows 27 are positioned generally between the upper light assembly 21 and the peripheral side wall 23 of the lower housing 17. The upper housing 18 may also include an inner liner 28 having a light reflective quality so that light 1 radiating from the upper light assembly 21 may be reflected off the inner liner 28 indirectly back through the opening 26 or upwardly towards the ceiling c.

In order to control the speed of rotation of the fan blades 13 the motor 12 has an unshown control switch which can be controlled conventionally through actuation of a pull string or electrical controller. Also, the upper and lower light assemblies 21 and 16 may be controlled through a unshown, conventional control switch.

Figure 2:
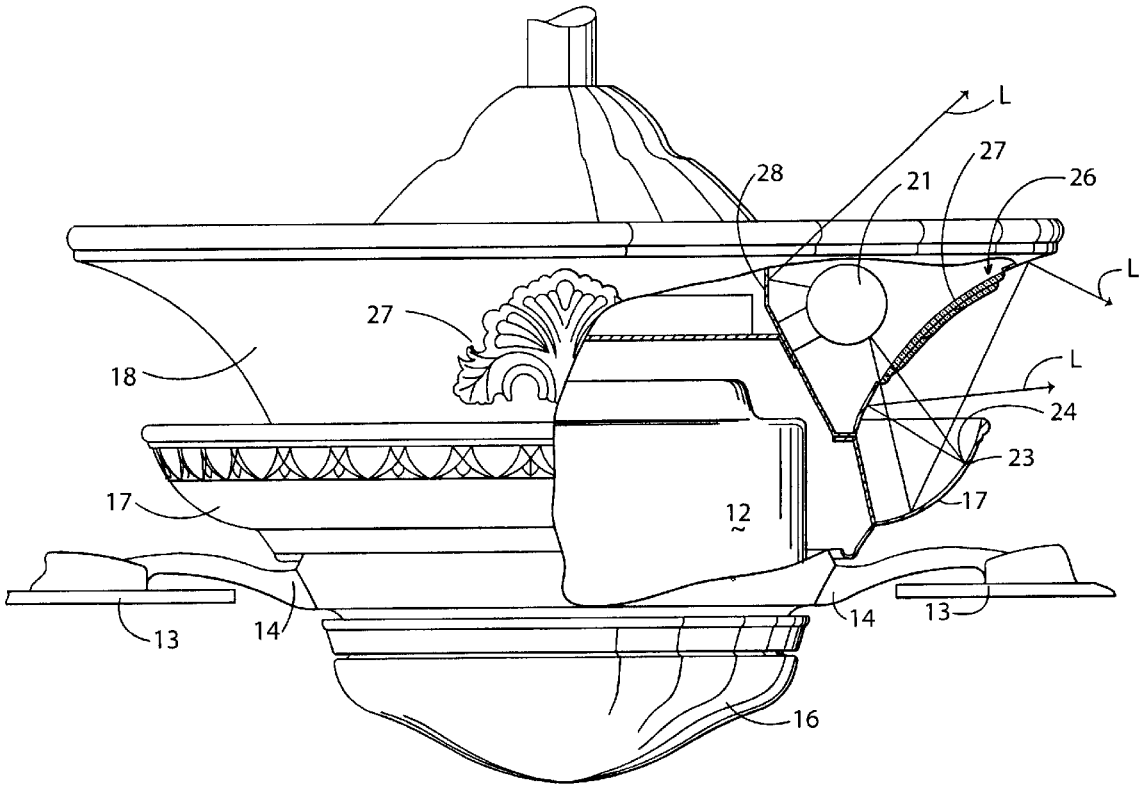
FIG. 2 is a side view, in partial cross-section, of the ceiling fan of FIG. 1.

In use, light from the lower light assembly 16 radiates downwardly so as to illuminate the room in which the ceiling fan is mounted. A portion of the light 1 from the upper light assembly 21 radiates upwardly to illuminate the ceiling c while other portions of the light 1 pass directly from the upper light assembly 21 or indirectly from the inner liner 28 through the upper housing openings 26 and onto the translucent windows 27 so as to illuminate the window 27. A portion of the light 1 radiating from the outwardly facing surface of the illuminated window 27 is directed towards the interior surface 24 of the lower housing 17. This light 1 reflects off the interior surface 24 of the lower housing wherein a portion thereof is directed back towards the exterior surface of the upper housing 18, as shown in FIG. 2. As such, the light 1 from the upper light assembly 21 not only illuminates the window but also indirectly illuminates the exterior of the upper housing through light radiating from the window 27 reflecting off the lower housing 17 and back upon the upper housing.

It should be understood that as this light emanates from the translucent window and is reflected from the interior of the lower housing the light reaching the exterior of the upper housing is greatly diffused. This diffusion of the light washes the entire upper housing in a bath of light rather than creating an uneven illumination of the upper housing with contrasting areas of intense and weak light, a problem associated with ceiling fans of the prior art wherein a light source is positioned directly adjacent the exterior of a motor housing.

It should be understood that other conventional types of lights may be used as an alternative to the tubular lighting shown as the upper light assembly in the preferred embodiment, such as a series of incandescent light bulbs mounted within the upper housing. Should a series of incandescent bulbs be utilized each bulb may be placed between adjacent windows rather than directly behind a window so that the light is not concentrated behind the window but rather diffused prior to passing through the window. This positioning of the bulbs prevents a bright area from appearing directly behind the window which may allow the bulb's shape or filament to be viewed. It should be understood that as an alternative to the annular lower housing 17 shown in the preferred embodiment, the lower housing may be in the form of a plurality of housings or shields each associated with an opening or window, i.e. a lower housing which comprises of a series of shields.

It should also be understood that while the translucent window, of glass, plastic, crystal, mica or the like, provides a benefit of diffusing the light from the upper light assembly, the present invention is not limited to such. In such an alternative embodiment the light would still pass through the opening within the upper housing and be reflected off the interior surface 24 back upon the exterior surface of the upper housing. Lastly, it should be understood that the upper and lower housings may be inverted so that the light passes through openings in the lower housing and is reflected off the interior surface of an upper housing back onto the exterior surface of the lower housing.

It thus is seen that a ceiling fan having lighting capabilities is now provided which overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A ceiling fan comprising:

an electric motor;

a plurality of blades coupled to said motor;

a lower housing having a light reflective interior surface;

an upper housing positioned with at least an upper portion above and facing said lower housing, said upper housing having at least one opening therethrough, and a light source mounted within said upper housing and positioned to radiate light through said upper housing opening and onto said lower housing interior surface, whereby a portion of the light passing through the opening and onto the interior surface is reflected onto and thereby illuminates the exterior of the upper housing facing the lower housing.

2. The ceiling fan of claim 1 wherein said interior surface is concave.

3. The ceiling fan of claim 1 further comprising a window positioned within said opening.

4. The ceiling fan of claim 3 wherein said window is translucent.

5. The ceiling fan of claim 3 wherein said window diffuses light passing therethrough.

6. The ceiling fan of claim 1 further comprising a second light source mounted below the motor and plurality of blades.

7. A ceiling fan comprising:

an electric motor;

a plurality of blades coupled to said motor;

a lower housing having a light reflective interior surface;

an upper housing having at least an upper portion positioned above and facing said lower housing, said upper housing having a plurality of openings therethrough;

a light diffusing member associated with each said opening within said upper housing, and light producing means for producing visible light, said light producing means being mounted within said upper housing and positioned to directly or indirectly radiate light through said upper housing openings, through said light diffusing members, and onto said lower housing interior surface, whereby a portion of the light passing through the light diffuser and onto the interior surface is reflected onto and thereby illuminates the surface of the upper housing facing the lower housing.

8. The ceiling fan of claim 7 wherein said lower housing interior surface is concave.

9. The ceiling fan of claim 7 wherein said light diffusing member is a translucent window.

10. The ceiling fan of claim 7 further comprising a second light producing means mounted below the motor and plurality of blades.

11. A ceiling fan comprising:

an electric motor;

a plurality of blades coupled to said motor;

a first housing member having a light reflective interior surface;

a second housing member having at least a portion facing said first housing member, said second housing member having at least once opening therethrough; and a light source mounted within said second housing member positioned to directly or indirectly radiate light through said second housing member opening and onto said first housing member interior surface, whereby a portion of the light passing through the opening and onto the interior surface is directed back towards and thereby illuminates the second housing member portion facing the lower housing.

12. The ceiling fan of claim 11 further comprising a light diffusing member associated with said opening within said second housing member.

13. The ceiling fan of claim 11 wherein said first housing member interior surface is concave.

14. The ceiling fan of claim 12 wherein said light diffusing member is a translucent window.

15. The ceiling fan of claim 11 further comprising a second light source mounted below the motor and plurality of blades.

* * * * *